US009357821B1

(12) United States Patent
Montoya

(10) Patent No.: US 9,357,821 B1
(45) Date of Patent: Jun. 7, 2016

(54) SUITCASE CONVERTIBLE TO A DUAL COMPARTMENT WAGON

(71) Applicant: Jennifer Montoya, Rockford, IL (US)

(72) Inventor: Jennifer Montoya, Rockford, IL (US)

( * ) Notice: Subject to any disclaimer, the term of this patent is extended or adjusted under 35 U.S.C. 154(b) by 0 days.

(21) Appl. No.: 14/687,532

(22) Filed: Apr. 15, 2015

(51) Int. Cl.

| | |
|---|---|
| ***A45C 5/00*** | (2006.01) |
| ***A45C 9/00*** | (2006.01) |
| ***A45C 5/14*** | (2006.01) |
| ***A45C 13/00*** | (2006.01) |
| ***A45C 13/38*** | (2006.01) |

(52) U.S. Cl.
CPC ... *A45C 9/00* (2013.01); *A45C 5/14* (2013.01); *A45C 13/005* (2013.01); *A45C 13/385* (2013.01); *A45C 2009/005* (2013.01)

(58) Field of Classification Search
CPC ..... A45C 9/00; A45C 3/10; A45C 5/14; A45F 4/02; A47D 5/006
USPC ..... 190/1, 18 A, 13 R, 114, 111, 110, 109, 190/108; 280/47.26, 47.19, 639; 224/582, 224/153; 206/579
See application file for complete search history.

(56) References Cited

U.S. PATENT DOCUMENTS

| | | | | | |
|---|---|---|---|---|---|
| 3,061,057 | A * | 10/1962 | Miller | A45C 7/0086 | 190/110 |
| 3,413,011 | A * | 11/1968 | Weitzner | A45C 5/146 | 280/37 |
| 3,606,372 | A * | 9/1971 | Browning | A45C 5/14 | 16/113.1 |
| 4,063,581 | A * | 12/1977 | Williams | A45C 5/14 | 190/18 A |
| 4,792,025 | A | 12/1988 | Thomas | | |
| 4,795,030 | A * | 1/1989 | Boyce | G10G 7/005 | 190/108 |
| 5,544,792 | A * | 8/1996 | Arnwine | A45C 7/0086 | 224/153 |
| 5,673,827 | A * | 10/1997 | Lamberti | A45C 3/004 | 160/127 |
| 5,749,446 | A | 5/1998 | Hsieh | | |
| 5,947,487 | A * | 9/1999 | Keleny | A43B 5/1683 | 188/5 |
| 5,947,489 | A * | 9/1999 | Tucker | B25H 5/00 | 280/32.6 |
| 6,016,893 | A * | 1/2000 | Chen | A45C 5/14 | 190/1 |
| 6,095,348 | A * | 8/2000 | Karashima | A47F 5/103 | 211/175 |
| 6,305,587 | B1 * | 10/2001 | Miller | A45C 7/0068 | 224/153 |
| 6,637,633 | B1 * | 10/2003 | Eberle | A45C 7/0059 | 190/103 |
| 6,644,448 | B2 * | 11/2003 | Bernbaum | A45C 3/00 | 190/111 |
| 7,322,477 | B2 * | 1/2008 | Schweitz | A45C 7/009 | 150/111 |
| 8,016,089 | B1 * | 9/2011 | McNichols | A45C 5/14 | 190/1 |
| 8,118,145 | B1 | 2/2012 | Hamamy et al. | | |
| 2006/0165318 | A1 * | 7/2006 | Gotesson | A45F 4/02 | 383/106 |

* cited by examiner

*Primary Examiner* — Fenn Mathew
*Assistant Examiner* — Cynthia Collado
(74) *Attorney, Agent, or Firm* — Crossley & Stevenson IP Law

(57) ABSTRACT

A suitcase convertible to a dual compartment wagon including a suitcase body with a pivotable U-shaped handle. Together, a first zipper continuously disposed along the left, top and right sides and a hinge continuously disposed on a bottom side of the suitcase body between the right and left sides define a forward portion and a rearward portion of the suitcase body which can have identical or different interior storage space depending on whether the first zipper is centrally disposed or more proximal one of the front and rear sides. The unzipped suitcase body folds out into an open wheeled wagon configuration with dual longitudinally aligned compartments in which the hinge conjoins the forward and rearward portions in a level longitudinally configured position with the front and rear sides parallel to and adjacent to a transport surface.

7 Claims, 3 Drawing Sheets

SUITCASE CONVERTIBLE TO A DUAL COMPARTMENT WAGON

BACKGROUND OF THE INVENTION

Various types of luggage are known in the prior art including a combination rolling cart and suitcase that provides a wheeled base suitcase, an external support frame, steel stabilizers, permanent adjustable straps and attachment points that couple the straps to secure one or more suitcases across a top portion of the combination rolling cart and suitcase. The prior art also includes convertible pushcart luggage having a single compartment suitcase with one pair of wheels on a telescopic handle end as well a second pair of wheels on an opposite end which slide out when the handle is pulled out of a channel connected from the suitcase. A luggage case convertible between a wheeled suitcase configuration and a wheeled cart configuration employs a pivotal handle supported by a strut pivotally fixed to the handle at one end and arranged at the other end to slide along a groove in a guide track fixed to the luggage case such that the strut can be stopped at a predetermined location along the groove with the handle fixed at an angle suitable for pushing the luggage case on its wheels. Another known device is a baggage cart suitcase which has a first case for storing items and a second case retractably coupled to the first case along with wheels couple to the first and second cases for moving the device and retaining fences retractably coupled to each of the first and second cases for holding items atop the device. However, what is needed is a suitcase convertible to a dual compartment wagon.

To address the foregoing need, the present suitcase is convertible to a dual compartment wagon by including a suitcase body with a pivotable U-shaped handle, a first zipper continuously disposed along a left side, the top side, and a right side of the suitcase body, and a hinge continuously disposed on a bottom side of the suitcase body between the right and lefts sides, terminating at the first zipper. The first zipper and the hinge together define a forward portion and a rearward portion of the suitcase body which can have identical or different interior storage space depending on whether the first zipper is centrally disposed or more proximal one of the front and rear sides. The hinge permits the suitcase body to be in a closed condition in which the first zipper is zipped and the forward and rearward portions are removably attached to each other along the entire first zipper and alternately in an open condition in which only the hinge conjoins the forward and rearward portions in a level longitudinally configured position with the front and rear sides parallel to and adjacent to a transport surface, such as a sidewalk, a vehicle parking surface, or an airport concourse floor, to form a wheeled wagon configuration with dual longitudinally aligned compartments.

An omnidirectional caster wheel is disposed on each of the bottom side proximal the front side in a position proximal each of the left side and the right side and the rear side proximal each of the top side and the bottom side in a position proximal each of the left side and the right side in an off-set arrangement for use when the suitcase is converted into the wheeled wagon configuration. At least one pocket is disposed on the front side and has A fastener, which can be a second zipper, thereon. Because the suitcase body folds out into the two conjoined wheeled compartments which when in the completely open condition are in a level longitudinal configuration with the front and rear sides parallel to a transport surface to form a wagon with four wheels, multiple items can be transported in the two compartments. Such items can include other travel bags, children, and groceries. The present device is also provided to reduce physical stress and strain, typically placed on an individual's back, arms, and shoulders, while transporting such items.

FIELD OF THE INVENTION

The present invention relates to suitcases, and more particularly, to a suitcase convertible to a dual compartment wagon.

SUMMARY OF THE INVENTION

The general purpose of the present suitcase convertible to a dual compartment wagon, described subsequently in greater detail, is to provide a suitcase convertible to a dual compartment wagon which has many novel features that result in a suitcase convertible to a dual compartment wagon which is not anticipated, rendered obvious, suggested, or even implied by prior art, either alone or in combination thereof.

To accomplish this, the present suitcase convertible to a dual compartment wagon includes a suitcase body having a U-shaped handle pivotably disposed on top side thereof proximal a front side thereof. A first zipper is continuously disposed along a left side, the top side, and a right side of the suitcase body. A hinge is continuously disposed on a bottom side of the suitcase body between the right and lefts sides, terminating at the first zipper. The first zipper and the hinge together define a forward portion and a rearward portion of the suitcase body. The forward and rearward portions have identical interior storage space when the first zipper is centrally disposed along the left side, the top side, and the right side; however, when the first zipper is disposed more proximal one of the front side and the rear side a larger interior storage space is provided in one of the forward and rearward portions, respectively. The hinge permits the suitcase body to be in a closed condition in which the first zipper is zipped and the forward and rearward portions are removably attached to each other along the entire first zipper and alternately in an open condition in which only the hinge conjoins the forward and rearward portions in a level longitudinally configured position with the front and rear sides parallel to and adjacent to a transport surface, such as a sidewalk, a vehicle parking surface, or an airport concourse floor, to form a wheeled wagon configuration with dual longitudinally aligned compartments.

An omnidirectional caster wheel is disposed on each of the bottom side proximal the front side in a position proximal each of the left side and the right side and the rear side proximal each of the top side and the bottom side in a position proximal each of the left side and the right side. The caster wheels disposed on the rear side proximal the top side are disposed more proximal the respective left and right sides than the caster wheels disposed on the rear side proximal the bottom side in an off-set arrangement. At least one pocket is disposed on the front side. A fastener, which can be a second zipper, is disposed on the at least one pocket.

A pair of brackets is disposed on the top side proximal the front side and an extension is disposed perpendicular to each of an outer end of the handle. The extension pivotally engages an aperture of a respective semicircular member of the respective pair of brackets. The extensions are simultaneously configured to pivot from a first position perpendicular to the top side when the suitcase body is in the closed condition to a second angled position at approximately a 45-degree angle relative the top side when the suitcase body is in the completely open condition for use of the suitcase body as a dual compartment wheeled wagon.

Because the suitcase body folds out into the two conjoined wheeled compartments which when in the completely open condition are in a level longitudinal configuration with the front and rear sides parallel to a transport surface to form a wagon with four wheels, multiple items can be transported in the two compartments. Such items can include other travel bags, children, and groceries. The present device is also provided to reduce physical stress and strain, typically placed on an individual's back, arms, and shoulders, while transporting such items. The suitcase body is provided in a wide range of sizes and materials which promote the functionality and conform to the structure described herein. Thus has been broadly outlined the more important features of the present suitcase convertible to a dual compartment wagon so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
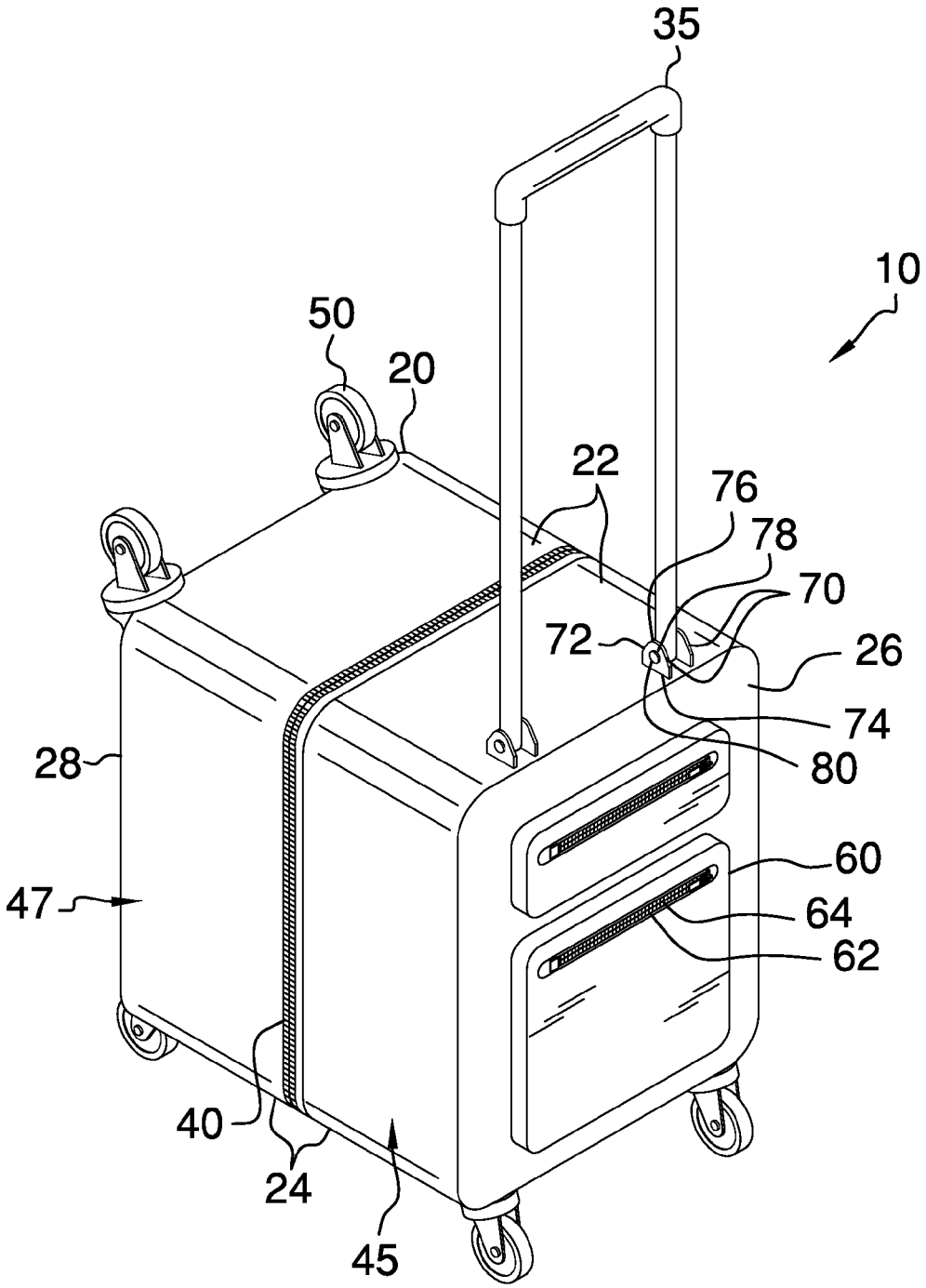
FIG. 1 is an isometric view in a completely closed condition.
Figure 2:
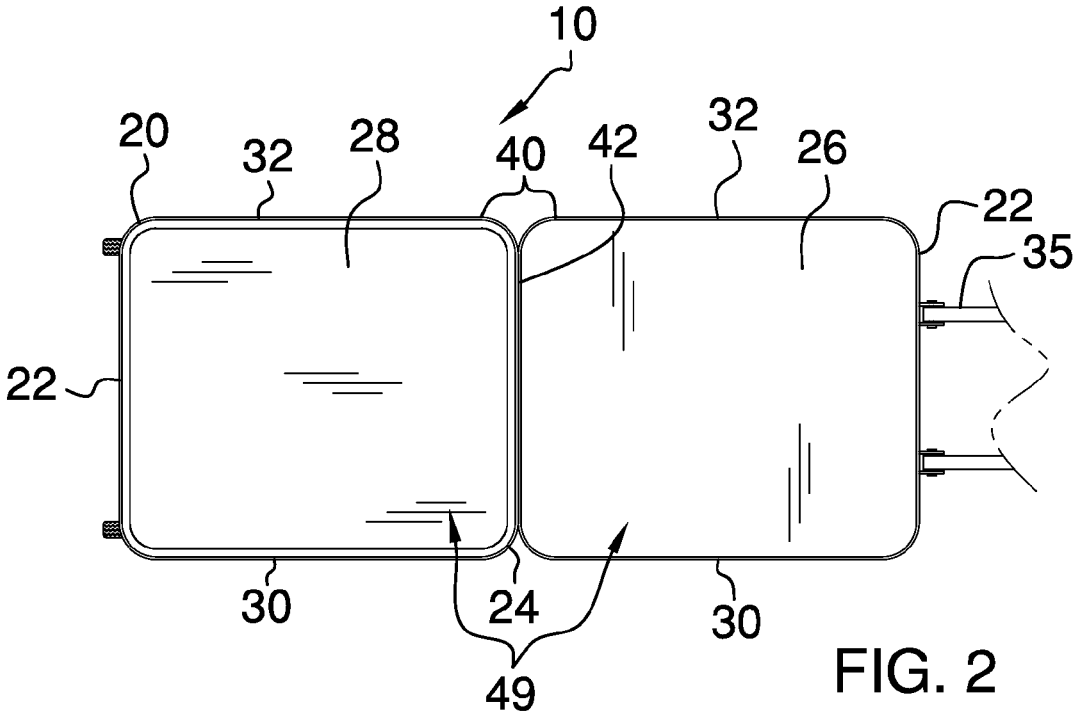
FIG. 2 is a top plan view in a completely open condition.
Figure 3:
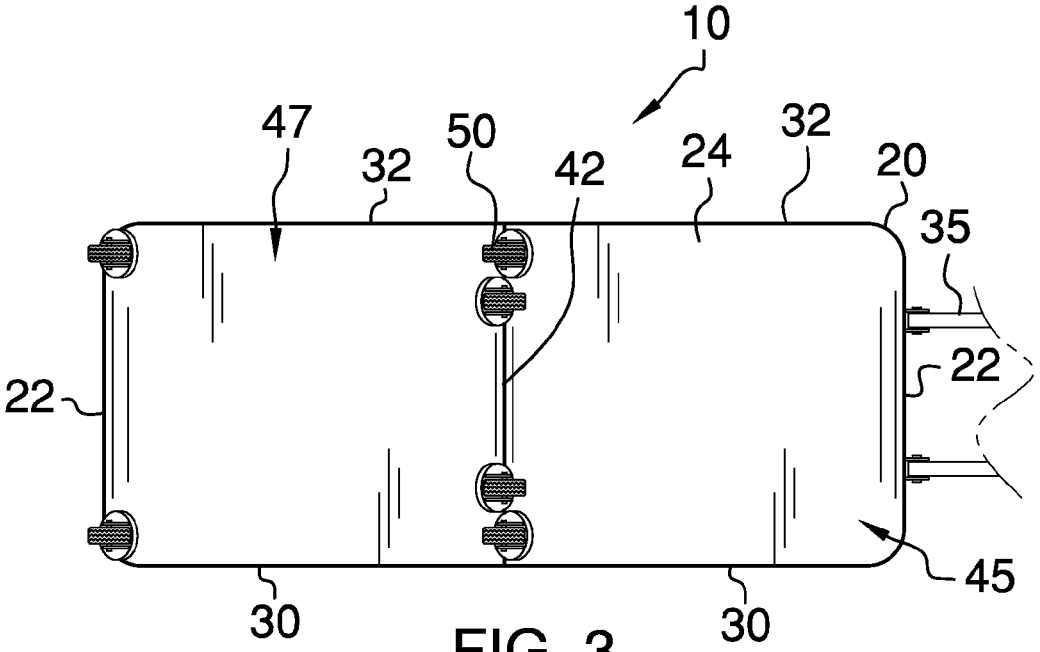
FIG. 3 is a bottom plan view in a completely open condition.
Figure 4:
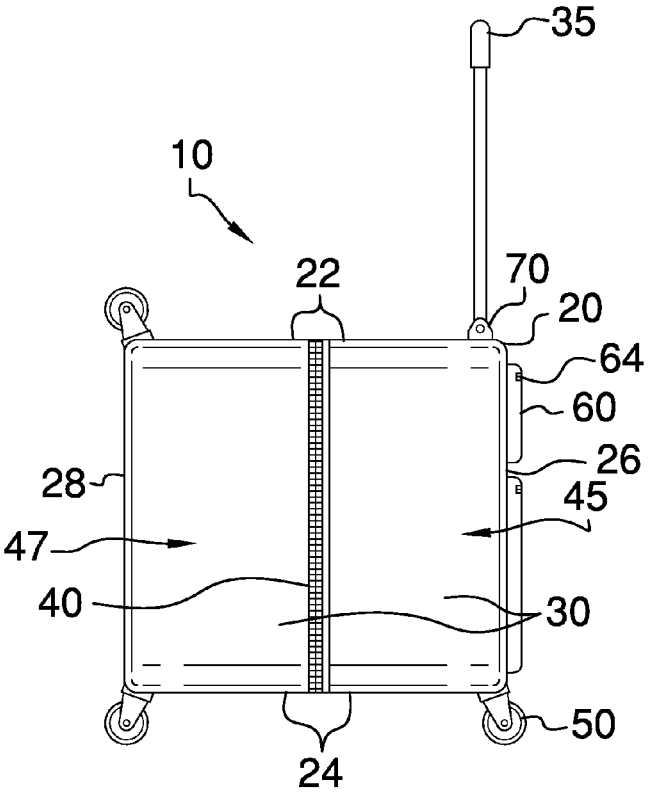
FIG. 4 is a side elevation view in a completely closed condition.
Figure 5:
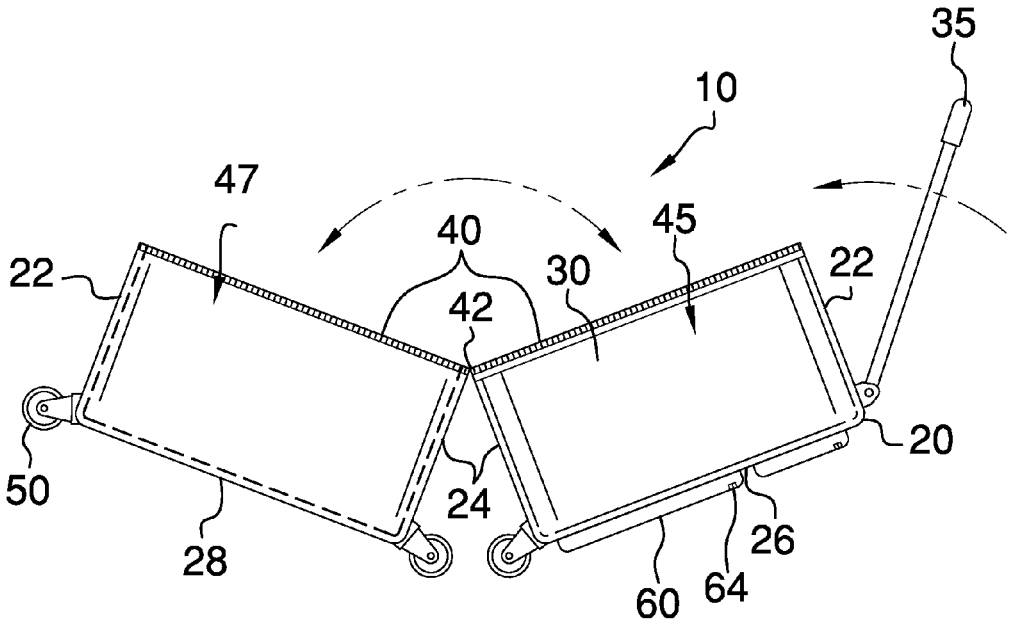
FIG. 5 is a side elevation view in a partially open condition with a handle shown in a pivoted position.

With reference now to the drawings, and in particular FIGS. 1 through 5 thereof, an example of the instant suitcase convertible to a dual compartment wagon employing the principles and concepts of the present suitcase convertible to a dual compartment wagon and generally designated by the reference number 10 will be described.

The suitcase convertible to a dual compartment wagon 10 includes a suitcase body 20 having a top side 22, a bottom side 24, a front side 26, a rear side 28, a left side 30, and a right side 32 identical to the left side 30. A U-shaped handle 35 is pivotably disposed on the top side 22 proximal the front side 26.

A first zipper 40 is continuously disposed along the left side 30, the top side 22, and the right side 32. A hinge 42 is continuously disposed on the bottom side 24 between the right side 32 and the left side 30 and terminates at the first zipper 40 on each of the left and right sides 30, 32. The first zipper 40 and the hinge 42 together define a forward portion 45 and a rearward portion 47 of the suitcase body 20. The forward and rearward portions 45, 47 have identical interior storage space 49 as shown when the first zipper 40 is centrally disposed along the left side 30, the top side 22, and the right side 32 as shown. However, the first zipper 40 can be disposed more proximal one of the front side 26 and the rear side 28 resulting in a larger interior storage space in one of the forward portion 45 and the rearward portion 47, respectively. The hinge 42 permits the suitcase body 20 to be in a closed condition as shown in FIG. 1 in which the first zipper 40 is completely zipped and the forward and rearward portions 45, 47 being removably attached to each other along the entire first zipper 40 and alternately in a completely open condition only the hinge 42 conjoins the forward and rearward portions 45, 47 and the forward and rearward portions 45, 47 are level in a longitudinally configured position with the front and rear sides 26, 28 parallel to and adjacent to a transport surface, such as a sidewalk, a vehicle parking surface, or an airport concourse floor, to form a wheeled wagon configuration with dual longitudinally aligned compartments 49.

An omnidirectional caster wheel 50 is disposed on each of the bottom side 24 proximal the front side 26 in a position proximal each of the left side 30 and the right side 32 and the rear side 28 proximal each of the top side 22 and the bottom side 24 in a position proximal each of the left side 30 and the right side 32. The caster wheels 50 disposed on the rear side 28 proximal the top side 22 are disposed more proximal the respective left and right sides 30, 32 than the caster wheels 50 disposed on the rear side 28 proximal the bottom side 24 in an off-set arrangement.

At least one pocket 60 is disposed on the front side 26. A fastener 62, which can be a second zipper 64, is disposed on the at least one pocket 60.

A pair of brackets 70 is disposed on the top side 22 proximal the front side 26. One of the pair of brackets 70 is disposed proximal each of the left and right sides 30, 32. Each of the pair of brackets 70 includes a pair of semicircular members 72. Each semicircular member 72 has a straight bottom end 74 affixed to the top side 22, an apex 76, and an aperture 78 central disposed therethrough proximal the apex 76. An extension 80 is disposed perpendicular to each of an outer end 82 of the handle. The extension 80 pivotally engages the aperture 89 of the respective semicircular member 72. The extensions 80 are simultaneously configured to pivot from a first position perpendicular to the top side 22 when the suitcase body 20 is in the closed condition to a second angled position at approximately a 45-degree angle relative the top side 22 when the suitcase body 20 is in the completely open condition.

What is claimed is:

1. A suitcase convertible to a dual compartment wagon comprising:

a suitcase body having a top side, a bottom side, a front side, a rear side, a left side, and a right side identical to the left side;

a U-shaped handle pivotably disposed on the top side proximal the front side;

a first zipper continuously disposed along the left side, the top side, and the right side;

a hinge continuously disposed on the bottom side between the right side and the left side, the hinge terminating at the first zipper on each of the right and left sides, wherein the first zipper and the hinge together define a forward portion and a rearward portion of the suitcase body, wherein the suitcase body has a closed condition and an alternate open condition, wherein both the first zipper and the hinge conjoin the forward and rearward portions in the closed condition, wherein only the hinge conjoins the forward and rearward portions of the suitcase body and the forward and rearward portions define dual longitudinally aligned compartments in the open condition with the front and rear sides being parallel to and adjacent to a transport surface; and an omnidirectional caster wheel disposed on each of the bottom side proximal the front side in a position proximal each of the left side and the right side and the rear side proximal each of the top side and the bottom side in a position proximal each of the left side and the right side, wherein the caster wheels disposed on the rear side proximal the top side are disposed more proximal the respective left and right sides than the caster wheels disposed on the rear side proximal the bottom side in an off-set arrangement;

wherein the suitcase in the closed condition is transformable into a wheeled wagon having dual longitudinally aligned compartments in the open condition.

2. The suitcase convertible to a dual compartment wagon of claim 1 further comprising at least one pocket disposed on the front side.

3. The suitcase convertible to a dual compartment wagon of claim 2 further comprising a fastener disposed on the least one pocket.

4. The suitcase convertible to a dual compartment wagon of claim 3 wherein the fastener is a second zipper.

5. A suitcase convertible to a dual compartment wagon comprising:

a suitcase body having a top side, a bottom side, a front side, a rear side, a left side, and a right side identical to the left side;

a U-shaped handle pivotably disposed on the top side proximal the front side;

a first zipper continuously centrally disposed along the left side, the top side, and the right side;

a hinge continuously disposed on the bottom side between the right side and the left side, the hinge terminating at the first zipper on each of the right and left sides, wherein the first zipper and the hinge together define a forward portion and a rearward portion of the suitcase body, wherein the suitcase body has a closed condition and an alternate open condition, wherein both the first zipper and the hinge conjoin the forward and rearward portions in the closed condition, wherein only the hinge conjoins the forward and rearward portions of the suitcase body and the forward and rearward portions define dual longitudinally aligned compartments in the open condition with the front and rear sides being parallel to and adjacent to a transport surface;

wherein the forward and rearward portions have identical interior storage space;

an omnidirectional caster wheel disposed on each of the bottom side proximal the front side in a position proximal each of the left side and the right side and the rear side proximal each of the top side and the bottom side in a position proximal each of the left side and the right side, wherein the caster wheels disposed on the rear side proximal the top side are disposed more proximal the respective left and right sides than the caster wheels disposed on the rear side proximal the bottom side in an off-set arrangement;

at least one pocket disposed on the front side;

a second zipper disposed on the at least one pocket;

a pair of brackets disposed on the top side proximal the front side, one of the pair of brackets disposed proximal each of the right and left sides, each of the pair of brackets comprising:

a pair of semicircular members, each semicircular member having a straight bottom end affixed to the top side, an apex, and an aperture central disposed therethrough proximal the apex; and an extension disposed perpendicular to each of an outer end of the handle, wherein the extension pivotally engages the aperture of the respective semicircular member;

wherein the suitcase in the closed condition is transformable into a wheeled wagon having dual longitudinally aligned compartments in the open condition.

6. The suitcase convertible to a dual compartment wagon of claim 5 wherein the extensions are simultaneously configured to pivot from a first position perpendicular to the top side when the suitcase body is in the closed condition to a second angled position at approximately a 45-degree angle relative the top side when the suitcase body is in an open condition with only the hinge conjoining the forward and rearward portions.

7. A suitcase convertible to a dual compartment wagon comprising:

a suitcase body having a top side, a bottom side, a front side, a rear side, a left side, and a right side identical to the left side;

a U-shaped handle pivotably disposed on the top side proximal the front side;

a first zipper continuously disposed along the left side, the top side, and the right side more proximal one of the front side and the rear side;

a hinge continuously disposed on the bottom side between the right side and the left side, the hinge terminating at the first zipper on each of the right and left sides, wherein the first zipper and the hinge together define a forward portion and a rearward portion of the suitcase body, wherein the suitcase body has a closed condition and an alternate open condition, wherein both the first zipper and the hinge conjoin the forward and rearward portions in the closed condition, wherein only the hinge conjoins the forward and rearward portions of the suitcase body and the forward and rearward portions define dual longitudinally aligned compartments in the open condition with the front and rear sides being parallel to and adjacent to a transport surface;

an omnidirectional caster wheel disposed on each of the bottom side proximal the front side in a position proximal each of the left side and the right side and the rear side proximal each of the top side and the bottom side in a position proximal each of the left side and the right side, wherein the caster wheels disposed on the rear side proximal the top side are disposed more proximal the respective left and right sides than the caster wheels disposed on the rear side proximal the bottom side in an off-set arrangement;

at least one pocket disposed on the front side;

a second zipper disposed on the at least one pocket;

a pair of brackets disposed on the top side proximal the front side, one of the pair of brackets disposed proximal each of the right and left sides, each of the pair of brackets comprising:

a pair of semicircular members, each semicircular member having a straight bottom end affixed to the top side, an apex, and an aperture central disposed therethrough proximal the apex; and an extension disposed perpendicular to each of an outer end of the handle, wherein the extension pivotally engages the aperture of the respective semicircular member;

wherein the suitcase in the closed condition is transformable into a wheeled wagon having dual longitudinally aligned compartments in the open condition.

* * * * *